United States Patent [19]

Christensen

[11] 3,981,063

[45] Sept. 21, 1976

[54] REDUCTION WRENCH HOLDER

[75] Inventor: Gordon R. Christensen, Calgary, Canada

[73] Assignee: The Raymond Lee Organization, Inc., a part interest

[22] Filed: Sept. 15, 1975

[21] Appl. No.: 613,108

[52] U.S. Cl. ..... 29/283; 81/180 R

[51] Int. Cl.[2] ..... B23Q 1/00

[58] Field of Search ..... 29/283; 81/180 R; 248/226 A

[56] References Cited

UNITED STATES PATENTS

| | | | |
|---|---|---|---|
| 323,380 | 7/1885 | Whissemore | 248/226 A |
| 2,960,895 | 11/1960 | Richards | 81/180 R |
| 3,262,341 | 7/1966 | Cline et al. | 81/180 R |

FOREIGN PATENTS OR APPLICATIONS

| | | | |
|---|---|---|---|
| 1,060,216 | 3/1967 | United Kingdom | 248/226 A |

*Primary Examiner*—James L. Jones, Jr.

[57] ABSTRACT

A V-shaped clamp has opposed first and second ends. The first end can accommodate the head of a conventional reduction wrench. The second end supports a threaded rod that approaches the first end when rotated clockwise as viewed from the top. A V-shaped bracket also has first and second ends. The first end of the bracket has a row of holes for accommodating the horizontal handle of a conventional reduction wrench and the second end has a row of holes for accommodating a downwardly and rearwardly extending bolt.

5 Claims, 3 Drawing Figures

REDUCTION WRENCH HOLDER

SUMMARY OF THE INVENTION

This invention is designed to hold a conventional tool that is used to remove and install cutting edges on heavy earth moving machines. These machines have a cutting edge that forms a V in cross section bolted onto the machine by a series of bolts. Because these bolts are tightened down very tightly, a reduction wrench, or torque multiplying wrench, is used to tighten them. The function of this invention is to hold the wrench on the particular nut or bolt that is to be tightened, permitting a power tool or other device to be easily applied to the wrench to operate it.

These wrenches had a head, to which a socket wrench may be attached, and an elongated handle. In this invention, a clamp encircles the point of the edge and presses the socket wrench on the head of the reduction wrench upwards to engage the nut or bolt. A bracket also encircles the point of the edge, but is held in place by a bolt that passes through the bracket. The handle of the reduction wrench passes through the bracket and is kept stationary thereby. Thus, the user of the reduction wrench does not have to hold the handle still manually—the invention does that for him, leaving his hands free to hold the tool that operates the reduction wrench.

DETAILED DESCRIPTION OF PREFERRED EMBODIMENTS

Figure 1:
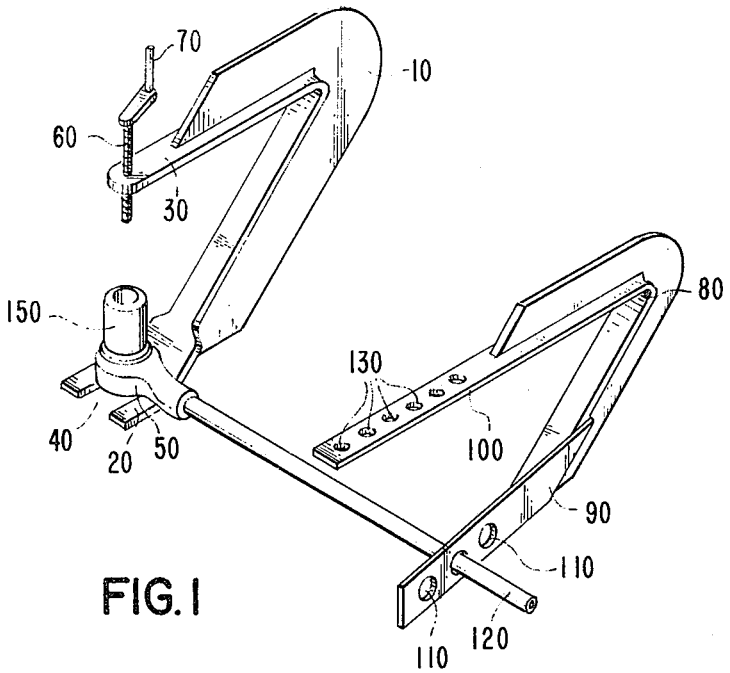
FIG. 1 shows a drawing of the invention holding a reduction wrench.

A V-shaped clamp 10 has a first end 20 and an opposed second end 30. The first end has two prongs separated by a slot 40, which engages the back of the head 50 of a reduction wrench. The second end supports a threaded rod 60 with a crank 70 at its upper end. When the crank is rotated clockwise, as viewed from the top, the rod is pushed towards the first end and the wrench head held therein.

A similarly shaped bracket 80 also has a first end 90 and a second end 100. The first end has a series of three holes 110 for holding the elongated handle 120 of the wrench. The second end has a row of holes 130 for accommodating a downwardly and rearwardly extending bolt.

Figure 2:
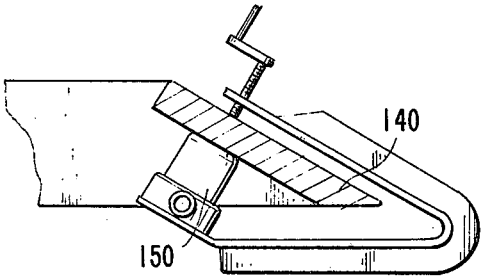
FIG. 2 shows a side view of the invention in use.
Figure 3:
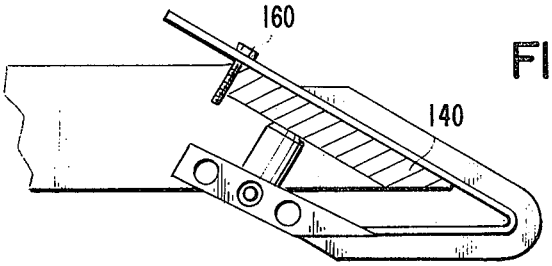
FIG. 3 shows another side view of the invention in use.

As is shown in FIG. 2, the clamp is placed around the cutting edge 140 that is to be installed or removed. The rod is then tightened, to press the socket wrench 150 upwardly around the nut or bolt that is to be tightened. The handle of the reduction wrench is passed through one of the holes 110, and the bracket is placed around the cutting edge in the same fashion as the clamp is placed.

A downwardly and rearwardly extending bolt 160 passes through one of the holes 130 to hold the V of the bracket against the edge. The bolt may pass next to the edge, or through it. The only function of the bolt is to keep the bracket from moving forwardly off the edge when the reduction wrench is operated.

Thus, the reduction wrench is held stationary—the head being held by the clamp and the handle being held by the bracket. The wrench may then be operated by a user who can use both his hands to operate his tool alone, without needing to keep one hand free to hold the handle of the reduction wrench.

The V-shaped clamp 10 and V-shaped bracket 80 each have a reinforcing rib which prevents the clamp or bracket from spreading open under stress.

Although the invention has been described with particular reference to the drawings, the protection sought is to be limited only by the terms of the claims which follow.

What is claimed is:

1. A reduction wrench holder for use on the cutting edges of heavy earth moving machines and the like, comprising:

- a V-shaped clamp with opposed first and second ends, the first end being designed to accommodate the head of a conventional reduction wrench;
- a threaded rod mounted in the second end of the clamp to approach the first end when rotated clockwise as viewed from the top; and
- a V-shaped bracket with first and second ends, the first end bearing a row of holes for accommodating the horizontal handle of a conventional reduction wrench and the second end having a row of holes for accommodating a downwardly and rearwardly extending bolt.

2. The holder of claim 1 wherein the first end of the clamp has two prongs separated by a slot.

3. The holder of claim 2 wherein a crank is secured to an end of the rod for rotating same.

4. The holder of claim 3 wherein the rod is perpendicular to the two prongs and the crank is secured to the upper end of the rod.

5. The holder of claim 3 wherein the clamp is placed around a cutting edge and a bolt passes through a selected one of the holes to hold the V of the bracket against the edge.

* * * * *